US011458479B2

(12) United States Patent
McKee

(10) Patent No.: US 11,458,479 B2
(45) Date of Patent: Oct. 4, 2022

(54) HOME CARDBOARD SHREDDER

(71) Applicant: Layne McKee, Oak Hills, CA (US)

(72) Inventor: Layne McKee, Oak Hills, CA (US)

( * ) Notice: Subject to any disclaimer, the term of this patent is extended or adjusted under 35 U.S.C. 154(b) by 72 days.

(21) Appl. No.: 16/935,039

(22) Filed: Jul. 21, 2020

(65) Prior Publication Data

US 2022/0023870 A1 Jan. 27, 2022

(51) Int. Cl.

| | |
|---|---|
| ***B02C 18/10*** | (2006.01) |
| ***B02C 18/24*** | (2006.01) |
| ***B02C 25/00*** | (2006.01) |
| ***B02C 18/00*** | (2006.01) |

(52) U.S. Cl.

CPC ..... *B02C 18/10* (2013.01); *B02C 18/0007* (2013.01); *B02C 18/0084* (2013.01); *B02C 18/24* (2013.01); *B02C 25/00* (2013.01); *B02C 2201/06* (2013.01)

(58) Field of Classification Search

CPC ..... B02C 18/0007; B02C 18/24; B02C 25/00
See application file for complete search history.

(56) References Cited

U.S. PATENT DOCUMENTS

| | | | | |
|---|---|---|---|---|
| 4,903,900 | A * | 2/1990 | Rousseau | B02C 18/0007 241/167 |
| 6,550,701 | B1 | 4/2003 | Chang | |
| 7,083,131 | B2 * | 8/2006 | Ting | B02C 18/0007 241/100 |
| 7,284,715 | B2 | 10/2007 | Dziesinski et al. | |
| 7,422,172 | B1 | 9/2008 | Lo | |
| 7,661,613 | B1 * | 2/2010 | Pan | B02C 18/0007 241/36 |
| 7,757,982 | B2 * | 7/2010 | Matlin | B02C 18/0007 241/36 |
| 8,424,787 | B2 | 4/2013 | Matlin et al. | |
| 9,669,410 | B2 | 6/2017 | Aries et al. | |
| 2005/0194480 | A1 * | 9/2005 | Yoshizawa | B02C 18/0007 241/65 |
| 2007/0034725 | A1 * | 2/2007 | Duh | B02C 18/0007 241/236 |
| 2007/0235573 | A1 * | 10/2007 | Johnson | B65F 1/0033 241/36 |
| 2008/0041988 | A1 * | 2/2008 | Wang | B02C 18/0007 241/100 |
| 2008/0099590 | A1 * | 5/2008 | Matlin | B02C 18/0007 241/36 |
| 2009/0026294 | A1 * | 1/2009 | Abramson | B02C 23/04 241/36 |

(Continued)

FOREIGN PATENT DOCUMENTS

| | | | | |
|---|---|---|---|---|
| DE | 2528268 | * | 6/1975 | B02C 18/0007 |

OTHER PUBLICATIONS

Second part of DE-2528268, Jun. 1975.*

*Primary Examiner* — Faye Francis

(57) ABSTRACT

A cardboard shredder provides a shredder for cardboard to facilitate recycling while reducing storage space needed before cardboard enters a recycling stream cutting out the middle man, thus the recycler receives uncontaminated cardboard since it is not mixed in with other materials. The manufacturer receives clean shredded cardboard for reuse, reducing headcount for the plant by reducing and eliminating their shredders being jammed with plastic. Thus, an improvement in efficiency and reduction in costs of material and water.

9 Claims, 3 Drawing Sheets

(56) References Cited

U.S. PATENT DOCUMENTS

| | | | | |
|---|---|---|---|---|
| 2010/0327091 | A1* | 12/2010 | Ko | B02C 18/0007 241/25 |
| 2011/0198425 | A1* | 8/2011 | Ko | B02C 18/0007 241/100 |
| 2011/0210194 | A1* | 9/2011 | Davis | B02C 18/0007 241/30 |

* cited by examiner

HOME CARDBOARD SHREDDER

FIELD OF THE INVENTION

This invention relates to shredders. More particularly, it relates to shredders for cardboard.

BACKGROUND

A paper shredder is a mechanical device used to cut paper into either strips or fine particles. Government organizations, businesses, and private individuals use shredders to destroy private, confidential, or otherwise sensitive documents.

Shredders range in size and price from small and inexpensive units designed for a certain number of pages, to large units used by commercial shredding services that cost hundreds of thousands of dollars and can shred millions of documents per hour. While the very smallest shredders may be hand-cranked, most shredders are electrically powered.

Shredders over time have added features to improve the shredder user's experience. Many now reject paper that is fed over capacity to avoid jams; others have safety features to reduce risks. Some shredders designed for use in shared workspaces or department copy rooms have noise reduction.

With society's increasing awareness of the world's dwindling supply of natural resources and overflowing landfills, many communities are providing and even mandating recycling services to its residents. The benefits of these efforts have already begun to be seen and will continue to be realized into the future. However, as with most beneficial programs, these efforts are accompanied by some burdens.

Perhaps one of the biggest burdens associated with recycling is the amount of space taken up in one's home by the recycled product before it enters the recycling stream. And of all of these recycled products perhaps none takes up more space than that of cardboard. This is especially true due to the large amount of cardboard that is utilized in the delivery process of goods ordered over the Internet. Even with crushing, folding, and cutting of cardboard products, they still occupy a large amount of volume.

Accordingly, there exists a need for a device by which the physical space occupied by cardboard to be recycled can be reduced while improving the overall efficiency of the cardboard recycling process. The consumer will have confidence knowing the large amount of boxes they receive from online purchases are being returned directly to the box manufacturer for recycling.

DETAILED DESCRIPTION

Figure 1:
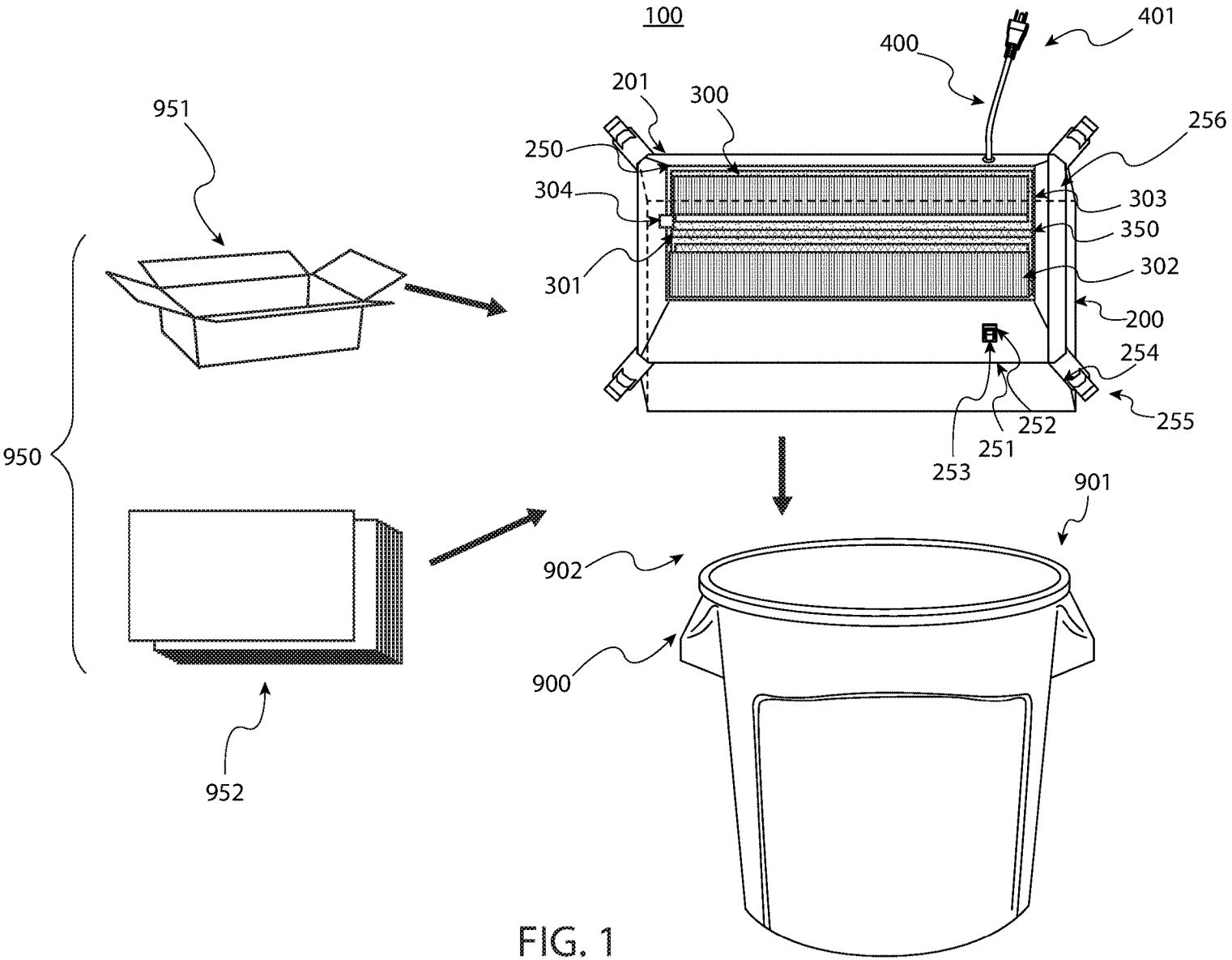
FIG. 1 is an illustrated view of an exemplary cardboard shredder.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated view of an exemplary cardboard shredder 100 for compressing and shredding cardboard 950 is presented. The cardboard shredder 100 provides a shredder for cardboard to facilitate recycling while reducing storage space needed before cardboard enters a recycling stream, thereby cutting out the middleman and allowing the recycler to receive uncontaminated cardboard since it is not mixed with other materials. The cardboard shredder 100 is a win for the environment by using less trees and water, a win for the consumer who receives a possible credit from the online merchant, a win for the supplier of the merchandise who keeps a good environmental public image and a huge marketing advantage over their competitors. The manufacturer receives clean shredded cardboard for reuse, reducing headcount for the plant by reducing and eliminating their shredders being jammed with plastic. Thus, an improvement in efficiency and reduction in costs of material and water is provided.

The cardboard 950 may be a cardboard box 951, a corrugated cardboard panel 952, etc. The cardboard shredder 100 further saves space in residential and commercial spaces and increases intervals between container emptying thus making recycling of cardboard easier, while saving time and money. The carboard shredder 100 is designed to fit over large garbage cans to eliminate double handling of the cardboard prior to recycling. The cardboard shredder 100 is easy and fun while encouraging recycling. The cardboard shredder 100 further accommodates larger sizes of product to be shredded than a conventional paper shredder, thereby encouraging the recycling of cardboard.

The cardboard shredder 100 is preferably the size of a standard household trash receptacle 900, however the cardboard shredder 100 could be any size. The cardboard shredder 100 preferably has a width of eighteen (18) inches, however other widths are hereby contemplated, including but not limited to, fourteen (14) inches, twenty-one (21) inches, etc. The cardboard shredder 100 preferably has a length of twenty (20) inches, however other lengths are hereby contemplated, including but not limited to, eighteen (18) inches, twenty-two (22) inches, etc. The cardboard shredder 100 is coupled to an interior 901 of a top 902 of the trash receptacle 900. The top 902 of the trash receptable 900 is preferably a rectangular shape, however other shapes are hereby contemplated, including, but not limited to, round, square, etc.

The cardboard shredder 100 has a body 200, a top 250, a center 300, and a cutting blade assembly 350. A bottom portion 201 of the body 200 is removably coupled to the interior 901 of the trash receptable 900.

The center 300 of the top 250 of the cardboard shredder 100 has an opening 301. The opening 301 of the center 300 of the top 250 of the cardboard shredder 100 is preferably one-half (0.5) inch in width, however other widths are hereby contemplated, including, but not limited to, one-fourth (0.25) inch, three-fourths (0.75) inch, etc. The cardboard 950 is placed into the opening 301 for shredding. The cardboard shredder 100 cuts the cardboard into strips and compresses it at the same time.

The opening 301 of the cardboard shredder 100 has a plurality of soft bristles 302. Below the soft bristles 302 is the cutting blade assembly 350. The opening 301 further has a rim 303. The rim 303 is preferably made of a metal, such as aluminum, steel, etc. The rim 303 further has a sensor 304. When the sensor 304 detects a hand being in contact with the rim 303, the sensor 304 sensor sends a message to an on/off switch 251 coupled to the top 250 of the cardboard shredder 250 to return the cutting blade assembly to an idle, non-working, state.

The on/off switch 251 is preferably a momentary rocker switch, however other types of switches are hereby contemplated. The on/off switch 251 preferably has a forward portion 252 and a reverse portion 253. When the forward portion 252 is actuated, the cutting blade assembly 350 is actuated in such a way as to allow the cutting blade assembly to be fed the cardboard 950 and shred the cardboard 950. When the reverse portion 253 is depressed, the cutting blade assembly 350 is actuated in the opposite direction such as to eject any remaining cardboard 950 from the cutting blade assembly 350. When the on/off switch 251 is released from being depressed, the cutting blade assembly 350 returns to an unpowered state.

The cardboard shredder 100 is a two-hand system, in that one hand is utilized to control the on/off switch 251 and the other hand is used to feed the cardboard 950 into the opening 301.

The cardboard shredder 100 has a plurality of clamps 255 coupled to each of a plurality of corners 254. Two of the corners 254 are coupled to a bar 256. The bar 256 is useful for pulling to couple the cardboard shredder 100 to the inside 901 of the trash receptacle 900.

The plurality of clamps 255 are preferably adjustable but may be static. The plurality of clamps 255 slide out from the top 250 of the cardboard shredder 100 and are coupled to the top 902 of the trash receptable 900 to suspend the cardboard shredder 100 in the interior 901 of the trash receptacle 900. Two of the clamps 255 are coupled to the bar 256. Once the cardboard shredder 100 has been initially coupled to the trash receptacle 900, the bar 256 is configured to be pulled to attach the clamps 255 coupled to the bar 256 to securely couple to the inside 901 of the trash receptacle 900. The clamps 255 are preferably Dorman 41101 type clamps, however other clamps are hereby contemplated such that one of skill in the art may choose other types of clamps.

The cardboard shredder 100 further has a power cable 400. The power cable 400 has a plug 401. The power cable 400 provides a power source to a motor 600, see FIG. 3 for details. The plug 401 is useful for coupling to an AC electric outlet (not shown).

Figure 2:
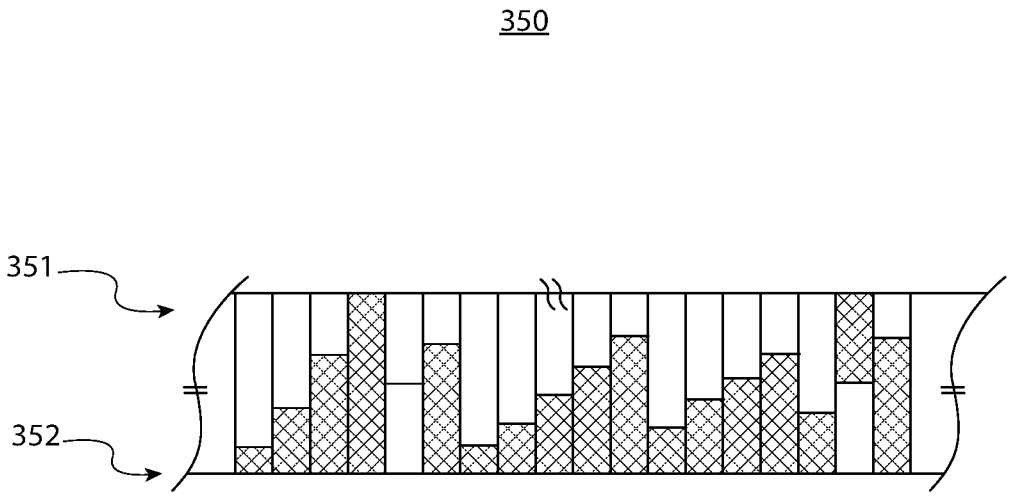
FIG. 2 is an illustrated view of a cutting blade assembly of the exemplary cardboard shredder shown in FIG. 1.

Referring now to FIG. 2, an illustrated view of a cutting blade assembly of the exemplary cardboard shredder shown in FIG. 1 is presented.

The cutting blade assembly 350 has two (2) cutter heads 351, 352. The cutter heads 351, 352 are spaced wider apart than conventional shredder cutters, which reduces the amount of cutting and in turn reduces the amount of power needed to shred the cardboard 950 and to power a motor 600, discussed in detail in FIG. 3. The motor 600 can be less powerful and smaller to shred the cardboard 950 due to reduced power needs. The cutter heads 351, 352 must be tight fitting to allow for scissor motions through the cardboard 950, similar to the action of scissors.

Figure 3:
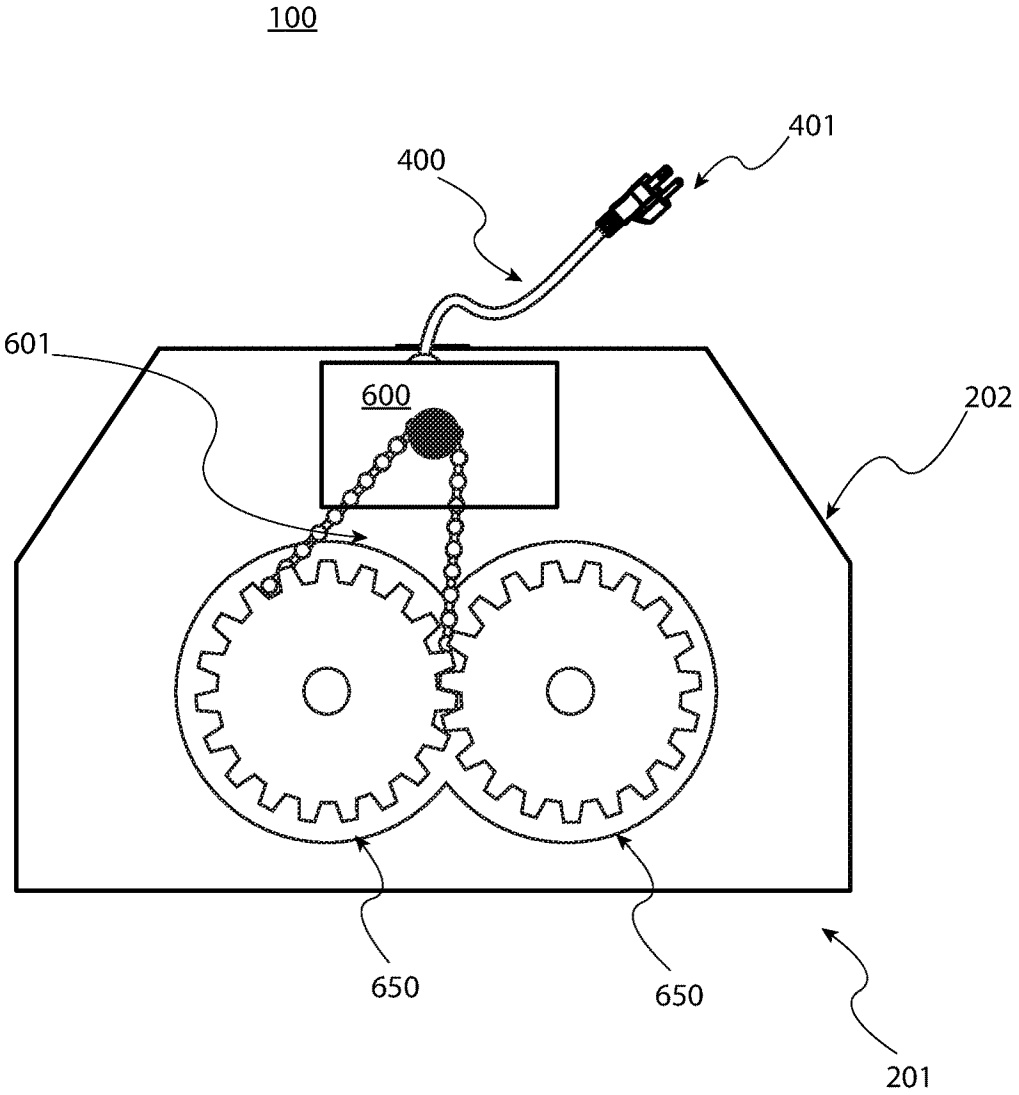
FIG. 3 is an illustrated view of a motor for the exemplary cardboard shredder shown in FIG. 1.

Moving now to FIG. 3, an illustrated view of a motor 600 for the cardboard shredder shown in FIG. 1 is presented.

The motor 600 is coupled to an interior 202 of the cardboard shredder 100. The motor 600 is coupled to one or more gears 650 by a coupling device 601. The coupling device 601 is preferably a chain belt, however other types of coupling devices are hereby contemplated, including, but not limited to, a rubber belt, a cloth belt, etc. The one or more gears 650 are coupled to each end of the cutter heads 351, 352 of FIG. 2. The gears 650 drive the cutter heads 351, 352 in a scissor like action.

The motor 600 is further coupled to a power source, preferably the power source being AC current, however batteries and other DC current devices are hereby contemplated. The motor 600 is coupled to the power source by the power cable 400 which is in turned coupled to an electrical socket by the plug 401.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cardboard shredder for shredding cardboard, the cardboard shredder consisting of:

a body, the body having an interior;

a top, the top having a center and a plurality of corners, wherein the center having an opening;

the opening having a plurality of soft bristles;

a rim, the rim being coupled to the opening, wherein the rim being a sensor for detecting a touching;

a cutting blade assembly, the cutting blade assembly having two (2) cutter heads, wherein the cutter heads being spaced apart by a pre-determined width;

a motor, the motor coupled to the interior of the body, the motor electrically coupled to a power source, the motor being mechanically coupled to a plurality of gears, wherein the gears being coupled to the cutter heads;

an on/off switch, the on/off switch having a forward portion and a reverse portion, where the on/off switch being communicatively coupled to the motor; and a plurality of clamps, the clamps being coupled to each of the corners of the top of the cardboard assembly, the clamps being removably coupled to an interior of a trash receptacle.

2. The cardboard shredder of claim 1, wherein the cardboard shredder having a length being fourteen (14) inches.

3. The cardboard shredder of claim 1, wherein when the rim detects a touching, the rim sending a message to the motor to be turned off.

4. The cardboard shredder of claim 1, wherein when the forward portion is actuated, the cutting blade assembly shredding the cardboard.

5. The cardboard shredder of claim 1, wherein when the reverse portion is actuated, the cutting blade assembly ejecting the cardboard.

6. The cardboard shredder of claim 1, wherein the on/off switch being a momentary rocker switch.

7. The cardboard shredder of claim 1, wherein the opening having a width being one-half (0.5) inch.

8. The cardboard shredder of claim 1, wherein the rim being made of a metal material.

9. A cardboard shredder for shredding cardboard, the cardboard shredder consisting of:

a body, the body having an interior;

a top, the top having a center and a plurality of corners, wherein the center having an opening;

the opening having a plurality of soft bristles, wherein the opening having a width being one-half (0.5) inch;

a rim, the rim being coupled to the opening, wherein the rim being a sensor for detecting a touching, wherein the rim being made of a metal material, wherein when the rim detects a touching, the rim sending a message to the motor to be turned off;

a cutting blade assembly, the cutting blade assembly having two (2) cutter heads, wherein the cutter heads being spaced apart by a pre-determined width;

a motor, the motor coupled to the interior of the body, the motor electrically coupled to a power source, the motor being mechanically coupled to a plurality of gears, wherein the gears being coupled to the cutter heads;

an on/off switch, the on/off switch having a forward portion and a reverse portion, where the on/off switch being communicatively coupled to the motor, wherein the on/off switch being a momentary rocker switch, wherein when the forward portion is actuated, the cutting blade assembly shredding the cardboard, wherein when the reverse portion is actuated, the cutting blade assembly ejecting the cardboard; and a plurality of clamps, the clamps being coupled to each of the corners of the top of the cardboard assembly, the clamps being removably coupled to an interior of a trash receptacle, wherein the cardboard shredder having a length being fourteen (14) inches.

* * * * *